United States Patent [19]

Groff, Sr.

[11] 3,962,989

[45] June 15, 1976

[54] PAINT SPRAY SHIELD

[76] Inventor: James H. Groff, Sr., Box 292 New Brooklyn Rd., Sicklersville P.O., N.J. 08081

[22] Filed: Dec. 11, 1974

[21] Appl. No.: 531,691

[52] U.S. Cl. ..... 118/504
[51] Int. Cl.[2] ..... B05C 11/00
[58] Field of Search ..... 118/301, 504, 505; 239/104, 150; 51/274

[56] References Cited

UNITED STATES PATENTS

| | | | |
|---|---|---|---|
| 554,403 | 2/1896 | Warncke | 118/504 |
| 1,164,449 | 12/1915 | Aycock | 118/505 |
| 1,927,743 | 9/1933 | Ivey | 118/301 X |
| 3,422,798 | 1/1969 | Pine | 118/504 |

FOREIGN PATENTS OR APPLICATIONS

| | | | |
|---|---|---|---|
| 683,776 | 12/1952 | United Kingdom | 118/504 |

*Primary Examiner*—John P. McIntosh
*Attorney, Agent, or Firm*—Woodcock Washburn Kurtz & Mackiewicz

[57] ABSTRACT

Apparatus for isolating an area of a surface to be spray painted, and preventing the spray from coating adjacent areas thereof. A pair of inclined, diverging walls are supported near one end thereof by a transverse support, leaving an elongate slot between convergent edges of the sides. A resilient pad extends beneath each of the sides and adjacent the slot for contacting a surface to be painted. In a preferred embodiment, the transverse support is curved inwardly, and a hand grip is provided. When held against a surface and a paint spray applied to the region of the slot, the inclined walls deflect the spray adjacent the slot upward and away from nearby surfaces while the resilient pads serve to sealingly define the edges of the area to be coated. The curved support near one end of the slot forces overspray blown toward it to be deflected lengthwise along the slot, away from the area in which a spray apparatus may be positioned.

8 Claims, 3 Drawing Figures

PAINT SPRAY SHIELD

BACKGROUND OF THE INVENTION

The present invention relates to apparatus for coating surfaces, and more particularly to shielding means for defining an area to be coated while deflecting sprayed coating material, not directed upon such area, away from adjacent areas.

In the painting of individual articles; as opposed to mass-produced or automatically applied coatings, it is often highly desirable to utilize a spray applicator such as an air brush, spray gun or aerosol device in order to achieve a smooth, uniform coating. While the advantages of spray coating have long been known to those skilled in the art the overspray which attends the process detracts considerably from its utility, necessitating elaborate masking and covering of adjacent areas so that the droplets of paint expelled from the spray apparatus do not adhere upon unwanted areas. For example, when painting an automobile the rubber moldings, chromium trim and glass windows must all be protected, commonly by applying an adhesive material such as masking tape to edges and small portions, while covering the extended areas with paper or plastic sheets. While this difficult and time-consuming operation may be justified when painting an entire vehicle it adds considerably to the time and expense required when repairing, or painting decorative trim,on the vehicle.

Of course, should it be necessary to paint an entire panel such as a door or a fender, the natural boundaries of the panel make masking of adjacent areas a simple task. However, when small, discrete areas are to be painted, such as when lettering, designs, or stripes are to be applied, it is necessary to mask and cover a large area about the small portion to be painted. In the case of decorative striping, the problem is even more acute since such striping often extends the entire length of the vehicle.

Although in years past manually-applied decorative striping was quite popular and commonly found on even mass produced automobiles, the increased expense of such painstaking work has caused it to become increasingly rare. While it is well known that it is possible to apply decorative striping by spray painting a narrow area defined by strips of adhesive tape, since such stripes commonly extend the length of the vehicle it is necessary to mask and protect practically the entire vehicle side, thus vitiating much of the economic advantage which would otherwise accrue to the spray process.

It is therefore an object of the present invention to provide means for confining a sprayed coating to a defined area, and preventing the overspray from adhering to adjacent areas.

It is a further object of the invention to provide an easily manipulable overspray deflector which eliminates the need for masking adjacent surfaces when spray painting decorative designs.

It is another object of the present invention to provide a hand-held overspray deflector which will prevent overspray from inconveniencing the operator of the apparatus.

SUMMARY OF THE INVENTION

Briefly stated, in accordance with one aspect of the invention the foregoing objects are achieved by providing a pair of generally parallel divergent wall members which are spaced so as to define an elongate slot at the convergent ends thereof. A pair of thick, resilient strips are attached beneath the convergent edges for conforming to and resiliently engaging a surface having a portion to be coated. A support disposed near the ends of the walls extends therebetween for rigidly maintaining them parallel to one another. In a preferred embodiment, the support is curved inwardly near the top thereof, so as to act as a deflector for preventing overspray from being blown directly upwardly, into the operator's line of vision. A hand grip attached to or formed in the apparatus facilitates the support of the apparatus so that it easily can be moved over an elongate area to be coated.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
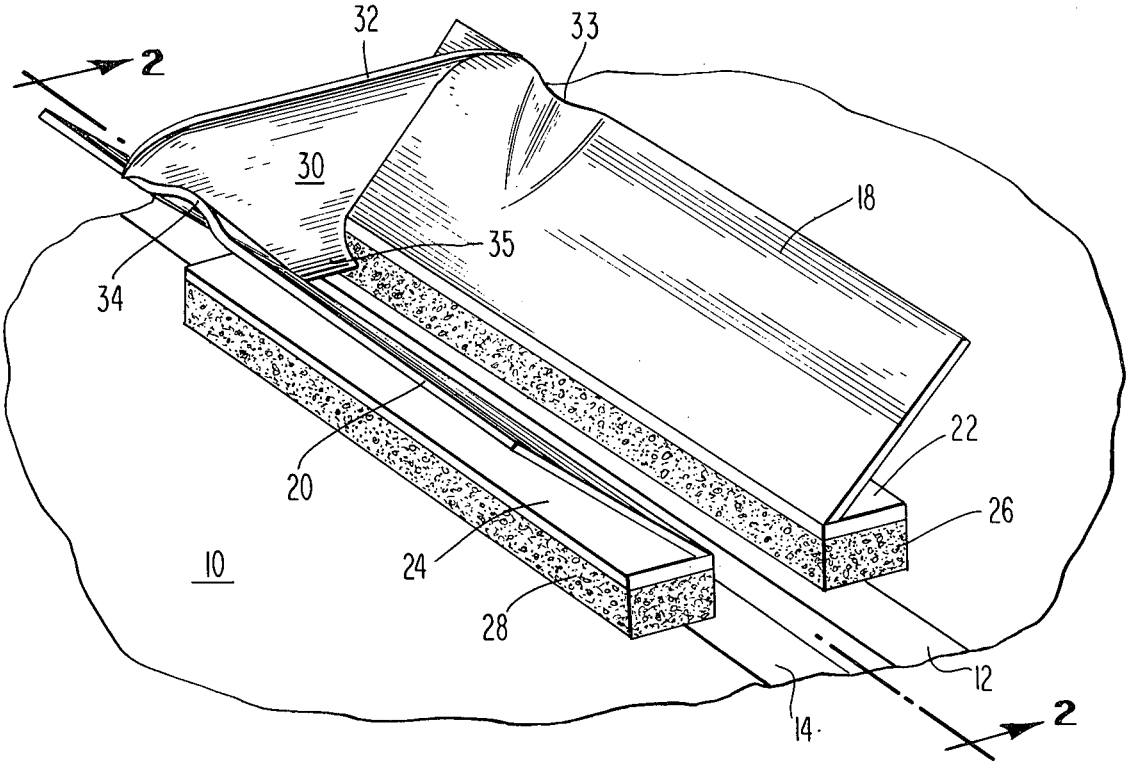
FIG. 1 is a perspective view of one embodiment of the apparatus.

FIG. 1 shows, in perspective, a surface 10 which is to have a decorative coating applied thereto. A pair of parallel strips to adhesive tape 12 and 14 are applied to the surface so as to define therebetween an area which is to be coated to form a decorative stripe. The overspray deflector, generally indicated at 16, is disposed over the tapes, exposing the narrow area between the tapes. The deflector comprises first and second diverging wall members 18 and 20 whose neighboring edges define an elongate slot and which diverge therefrom at a suitable angle. In the embodiment shown, rigid strips 22 and 24 are attached to the lower edges of the wall members, for supporting a pair of elongate resilient members 26 and 28, respectively. Members 26 and 28 are preferably both flexible and compressible so that they follow the contours of surface 10. In practice these members may comprise pads of cellular material, the specific material not being critical as long as it is substantially impervious to the coating material to be used. If necessary, the inner surfaces of the members may be protected by the application of a strip of impervious material, such as masking tape. Near one end of the wall members is a transverse support 30 which extends therebetween and supports the wall members in proper relationship with one another. The upper edge of support 30 is advantageously inwardly curved to form a deflecting surface, whose function will be explained hereinafter. If desired, a manually engageable hand grip may be associated with the deflector so that the apparatus may easily be manipulated by an operator. In one embodiment, a satisfactory grip is constituted by indentations 33 and 34 in the sidewalls 18 and 20, respectively.

Figure 2:
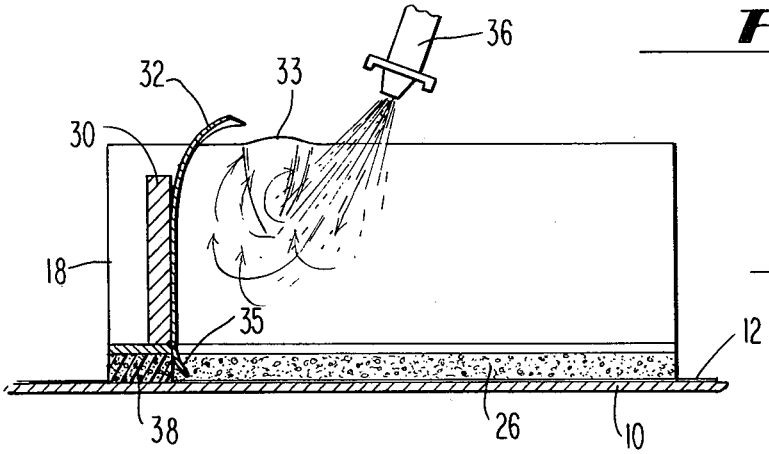
FIG. 2 is a sectional side elevation of the apparatus, taken along 2—2 of FIG. 1.

Turning now to FIG. 2 there is shown a sectioned side elevation of the apparatus, illustrating its operation. The device is lightly pressed against tape 14 which is disposed upon the surface 10. While it will be recognized that in some cases the masking adhesive tape may be dispensed with and the edges of the resilient pads beneath the overspray device relied upon to define the ultimate area to be coated, expreience has shown that for best results a masked outline or stencil should be used beneath the device. In any case, the pads serve to define the area to be coated, which area may include a portion of the masking tapes or stencil which is of course later removed to leave the desired design upon the original surface.

A spray applicator having a nozzle 36 is positioned near the divergent edges of the wall members 18 and 20, and coating sprayed directly onto the elongate slot between the wall members to coat the area therebetween. Since it is anticipated that in most applications, the deflector and the spray apparatus will be held manually and moreover that the operator will position himself closely to the apparatus for supervising the process, it is important that the overspray not be deflected directly toward his face or eyes. Not only will the overspray impair the visibility of the process but it could produce toxic or allergic reactions should it be inhaled or directed into the eyes of the user.

For this reason, a curved section 32 is advantageously associated with support 30. As shown illustrated by the arrows in the figure, the overspray droplets are agitated within the deflector by the air stream from the spray apparatus, setting up air currents which are directed by deflector 32 toward the far end of the slot. It has been found that after the droplets of sprayed coating travel a sufficient distance through the air, they are sufficiently dry so as not to adhere to any surrounding areas upon which they may settle, and may easily be dusted off. For this reason, it has been found unnecessary to provide any additional means for upwardly deflecting the droplets as they approach the open end of the deflector apparatus. Moreover, it is anticipated that most of these droplets will be blown upwardly by air currents deflected upwardly by the side walls.

In order to prevent the escape of paint spray beneath the closed end of the device, a resilient member or pad 38 may advantageously extend beneath support 30. Either additionally or in lieu thereof the apparatus may also include a lower deflector member 35 which prevents the spray from intruding from beneath support 30 and aids in effecting an upward current of air at the inner face of the support.

Figure 3:
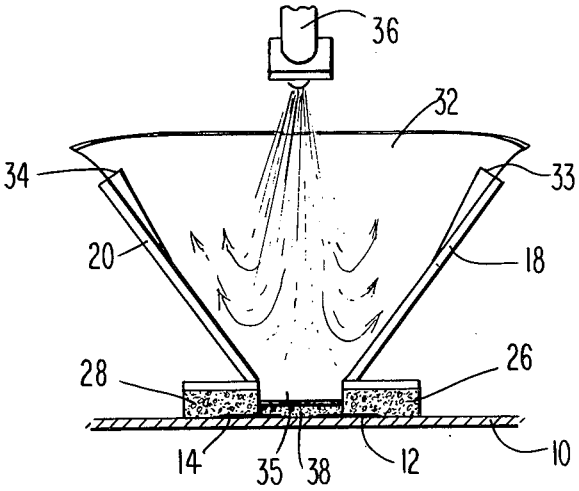
FIG. 3 is an end view of the apparatus.

FIG. 3 represents a view of the apparatus from the open end thereof. Resilient pads 26 and 28 easily conform to the contours of the adhesive masking tape, and to curves or undulations in the surface 10 which is to be coated. Thus, paint spray is prevented from escaping beneath the divergent side walls and impinging upon adjacent areas. A narrow gap 38 is present between the lower end of lower deflector member 33 and surface 10. The gap, shown in exaggerated form, merely provides sufficient clearance above the surface to be painted so that the movement of the device across an area already painted will not cause the lower end of the support or the deflector member to damage the newly-coated area. By properly orienting the nozzle 36, the overspray leakage through this small gap is made insignificant.

In FIG. 3 arrows are placed to generally denote the presumed flow of air currents within the device. The force of the spray coating introduced within the apparatus sets up air currents which escape upwardly along divergent side walls 18 and 20, carrying excess paint droplets away from the surface 10. As set forth above, although a few of such droplets may settle upon adjacent surfaces after having been deflected above the area being coated, after traveling along such an extended path they are essentially solidified and do not adhere to the adjacent surfaces.

In the illustrations it is plain that with the present invention a stripe or line of indefinite length may be painted, without the necessity for the masking or coverage of adjacent areas beyond the minimal application of adhesive tapes 12 and 14 for defining the precise bounds of the area to be coated. In this manner, for instance, a plurality of fine stripes extending the entire length of a vehicle may be quickly painted, while using a bare minimum of masking materials.

While in the embodiment shown the pads 26 and 28 are shown as being affixed to separate rigidifying elements 22 and 24, it will be immediately apparent that these members could easily be constituted by a lip or flange formed by bending the edges of the diverging wall members outwardly at the lower ends thereof. It has been found advantageous, however, to keep the width of the lower portion of the device to a minimum so that areas which lie close to upstanding objects such as door handles, trim, etc. may easily be reached. Depending upon the nature of the pads themselves, it may alternatively be possible to dispense with the rigidifying elements and attach the pads directly to the wall members themselves.

The walls, support members, and deflector of the present apparatus may be made from many suitable materials although it is preferable that the surfaces that are contacted by the sprayed paint be of a relatively hard, smooth nature so that accumulated paint may easily be removed. Further, while it is recognized that the entire apparatus may be molded from a single piece of plastic material, it is highly desirable to select a material which is not soluble in, or otherwise adversely effected by, the coating to be used. Finally, it will be appreciated that the apparatus may be provided with various sorts of manually engageable elements, the handgrip comprising indentations 33 and 34, 34 being only one example. Openings for receiving the fingers of the operator pistol grips and other arrangements may alternatively be selected to suit the application and the preference of the user.

As will be evident from the foregoing description, certain aspects of the invention are not limited to the particular details of the examples illustrated, and it is therefore contemplated that other modifications or applications will occur to those skilled in the art. It is accordingly intended that the apended claims shall cover all such modifications and applications as do not depart from the true spirit and scope of the invention.

What is claimed as new and is desired to be secured by Letter Patent of the United States is:

1. Shielding means for use with a coating applicator of the spray type for preventing the spray coating from falling upon adjacent areas, comprising:

a pair of opposing side members separated by an elongate opening, said members converging towards said opening;

first and second resilient members disposed beneath said side members at either side of said openings; and a support member extending between said side members near one end of said opening, said support means comprising a lower segment substantially closing one end of the opening between said side members, said lower segment being curved inwardly between said side members for deflecting sprayed particles upwardly and away from said opening, and an upper portion curved downwardly toward said side members for deflecting sprayed particles downwardly toward said opening to prevent particles from being expelled upwardly between said divergent wall members.

2. The invention defined in claim 1, wherein said upper portion comprises a curved surface near the wider portion thereof, said surface being curved toward the distal end of said opening.

3. The invention defined in claim 2, further including hand grip means for manually positioning said shielding means.

4. The invention defined in claim 3, wherein said resilient members are formed of cellular material.

5. An overspray deflector device for exposing a portion of a surface to be spray coated and protecting other portions thereof, comprising:

first and second diverging wall members, said wall members defining a slot between the coverging edges thereof;

a resilient pad disposed beneath said wall members at opposite sides of said slot for defining a portion of a surface to be painted; and deflector means extending transversely between said wall members and disposed near one end thereof, said deflector means having a lower portion extending into said slot, said lower portion being curved upwardly to urge spray particles away from said slot and having an upper portion curved downwardly for deflecting overspray arising from the area between said wall members downwardly and toward the end of said slot opposite the deflector, the opposed edges of said upper portion being further curved laterally inwardly to prevent overspray from escaping toward the sides of said apparatus.

6. The invention defined in claim 5, further including manually engageable means for grasping said overspray deflector device.

7. The invention defined in claim 6, wherein the upper portion of said deflector means is curved and extends generally transversely between the divergent ends of said wall members.

8. The invention defined in claim 7, wherein said deflector means further comprises a lower portion, said lower surface being curved and extending into said slot.

* * * * *